US012704277B2

(12) United States Patent
Martin

(10) Patent No.: US 12,704,277 B2
(45) Date of Patent: Aug. 11, 2026

(54) VENT AND ROOF VENT ASSEMBLY

(71) Applicant: TS Innovations LLC, Ephrata, PA (US)

(72) Inventor: Timothy L. Martin, Reinholds, PA (US)

(73) Assignee: TS Innovations LLC, Ephrata, PA (US)

( * ) Notice: Subject to any disclaimer, the term of this patent is extended or adjusted under 35 U.S.C. 154(b) by 568 days.

(21) Appl. No.: 18/167,511

(22) Filed: Feb. 10, 2023

(65) Prior Publication Data

US 2024/0271803 A1 Aug. 15, 2024

(51) Int. Cl.
*F24F 7/02* (2006.01)

(52) U.S. Cl.
CPC ..... *F24F 7/02* (2013.01)

(58) Field of Classification Search
CPC ..... F24F 7/02
USPC ..... 121/37, 367
See application file for complete search history.

(56) References Cited

U.S. PATENT DOCUMENTS 2,985,091 A * 5/1961 Hatcher ..... E04D 13/1471 454/366
4,333,660 A 6/1982 Cupit
4,437,687 A 3/1984 Wilson
4,461,066 A * 7/1984 Peterson ..... F24F 7/02 29/516
7,114,301 B2 10/2006 Bibaud et al.
8,209,923 B1 7/2012 Rich
D757,924 S 5/2016 Briggs et al.
10,024,061 B2 * 7/2018 Ainger ..... E04D 13/1476
10,161,135 B2 * 12/2018 DeGraan ..... F24F 7/02
10,180,260 B2 * 1/2019 Mantyla ..... F16K 24/04
2019/0249439 A1 8/2019 Oddy
2022/0057090 A1 * 2/2022 King, Jr. ..... F24F 7/02

FOREIGN PATENT DOCUMENTS

DE 200 08 382 U1 11/2000
DE 10028898 C1 * 8/2001 ..... E04D 13/1407
DE 20 2005 012 054 U1 11/2005

* cited by examiner

*Primary Examiner* — Avinash A Savani
*Assistant Examiner* — Dana K Tighe
(74) *Attorney, Agent, or Firm* — Barley Snyder

(57) ABSTRACT

A vent includes a vent body and a boot attached to the vent body. The vent body has a vent pipe and a body flange monolithically formed in a single piece with the vent pipe. The vent pipe has a vent passageway extending through the vent pipe from a first vent end to an opposite second vent end. The body flange is positioned along the vent pipe between the first vent end and the second vent end. The boot is formed of a flexible resilient material and has a first boot end with a boot flange and a second boot end connected to an outer surface of the vent pipe. At least a portion of the boot flange is disposed in a same plane as the body flange.

22 Claims, 8 Drawing Sheets

VENT AND ROOF VENT ASSEMBLY

FIELD OF THE INVENTION

The present invention relates to a vent and, more particularly, to a vent for a roof.

BACKGROUND

A building often requires ventilation through the roof of the building for certain rooms within the building, such as for dispersing hot air in an attic or moist air in a bathroom. A vent is installed in the roof to provide a fluid pathway through the roof from the interior of the building to the exterior of the building, or to provide air exchange between the interior of the building and the exterior of the building.

Sealing the interface between the vent and the roof to prevent moisture and dirt from entering between layers of the roof and/or into the building is critical to prevent deterioration and damage to the structure. While vents are known for many types of roofs, including asphalt roofs, vents for concealed fastener or exposed fastener metal roofs are more challenging to seal.

SUMMARY

A vent includes a vent body and a boot attached to the vent body. The vent body has a vent pipe and a body flange monolithically formed in a single piece with the vent pipe. The vent pipe has a vent passageway extending through the vent pipe from a first vent end to an opposite second vent end. The body flange is positioned along the vent pipe between the first vent end and the second vent end. The boot is formed of a flexible resilient material and has a first boot end with a boot flange and a second boot end connected to an outer surface of the vent pipe. At least a portion of the boot flange is disposed in a same plane as the body flange.

BRIEF DESCRIPTION OF THE DRAWINGS

The invention will now be described by way of example with reference to the accompanying Figures, of which.

DETAILED DESCRIPTION OF THE EMBODIMENTS

Figure 1:
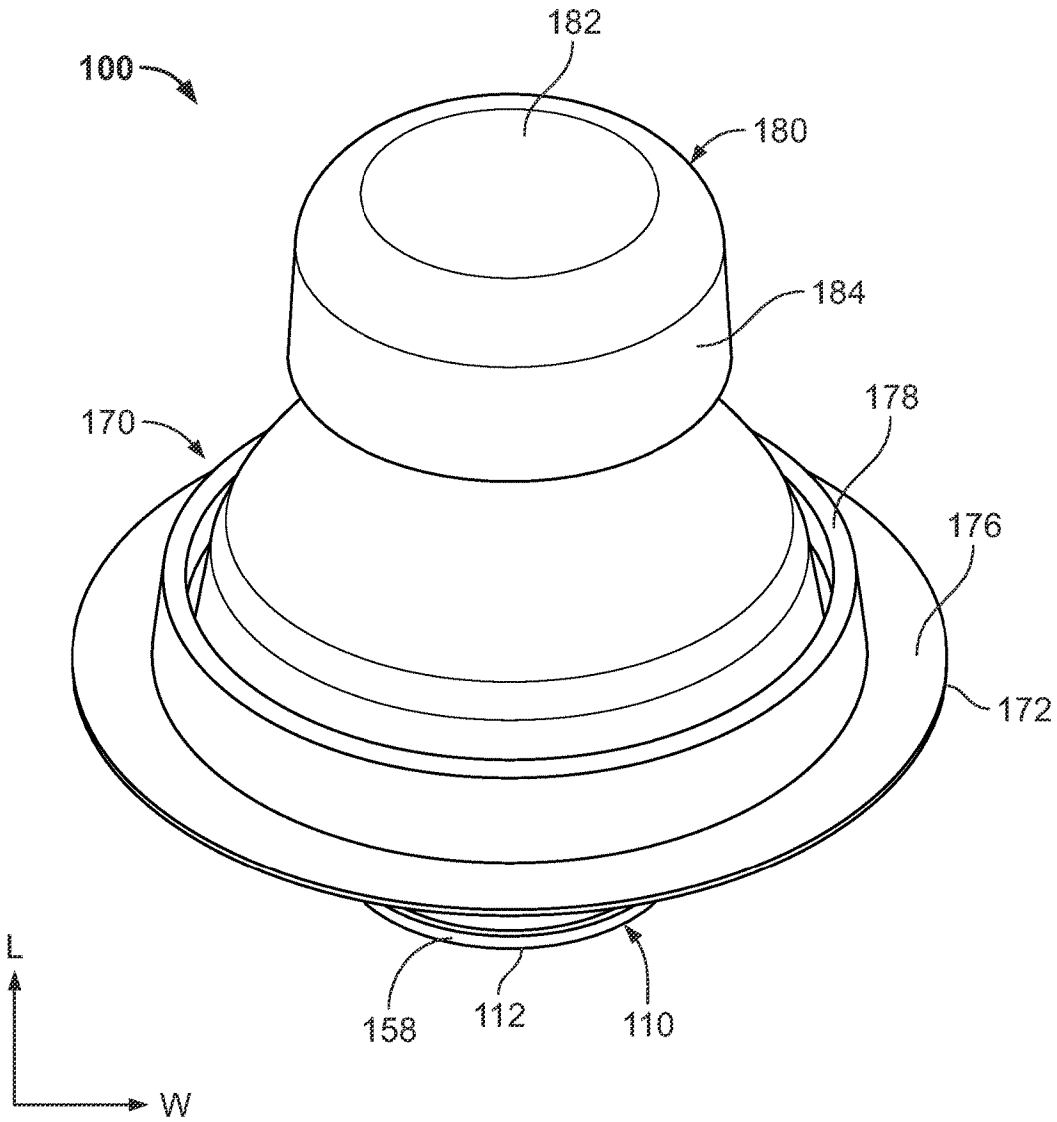
FIG. 1 is a perspective view of a vent according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth to provide a thorough understanding of the disclosed embodiments. However, it is apparent that one or more embodiments may also be implemented without these specific details.

Throughout the drawings, only one of a plurality of identical elements may be labeled in a figure for clarity of the drawings, but the detailed description of the element herein applies equally to each of the identically appearing elements in the figure. Throughout the specification, directional descriptors are used such as "longitudinal direction" and "width direction". These descriptors are merely for clarity of the description and for differentiation of the various directions. These directional descriptors do not imply or require any particular orientation of the disclosed elements.

A vent 100 according to an embodiment is shown in FIG. 1. The vent 100 includes a vent body 110, a boot 170 attached to the vent body 110, and a cap 180 disposed on the vent body 110.

Figure 2:
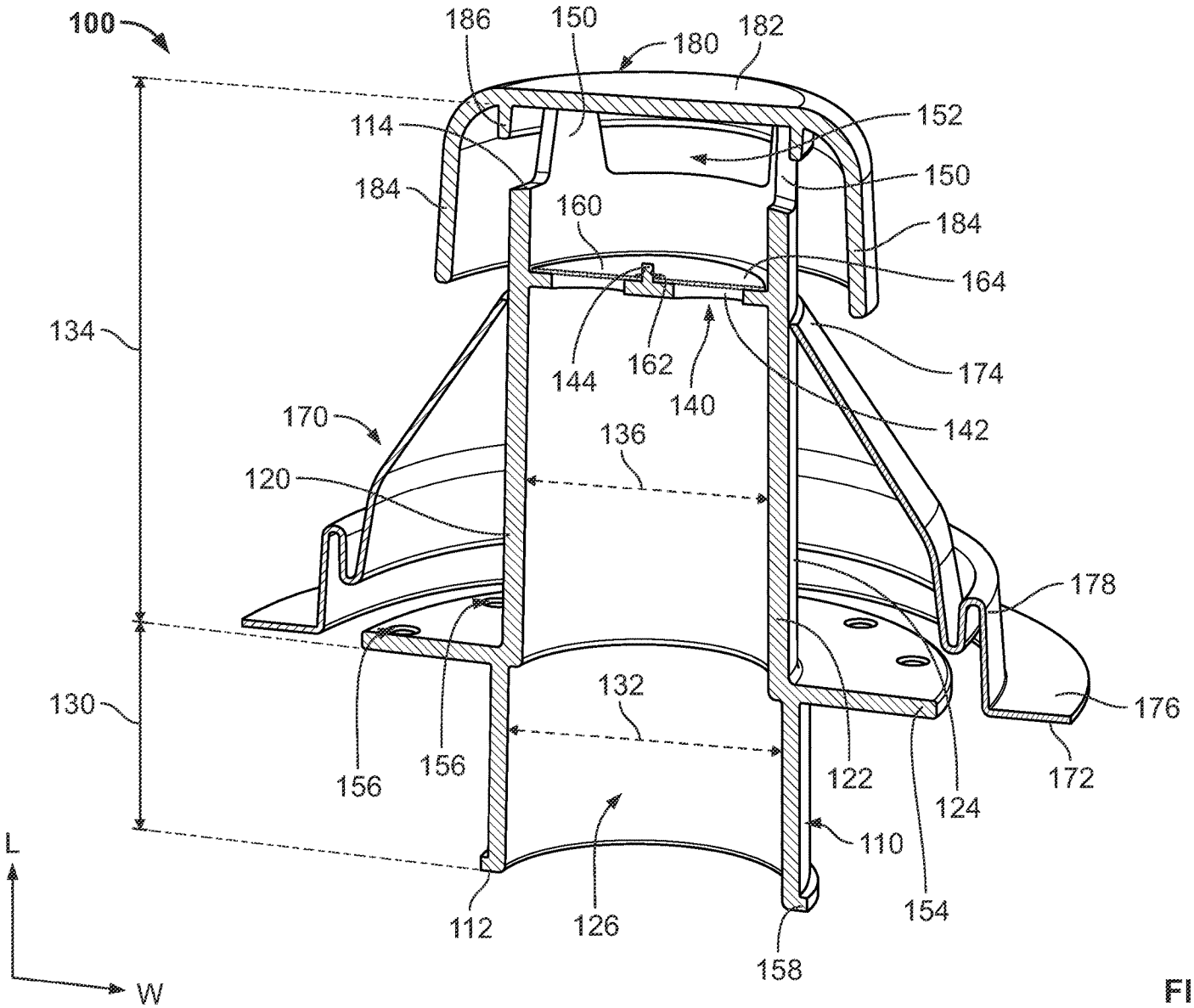
FIG. 2 is a sectional perspective view of the vent.
Figure 3:
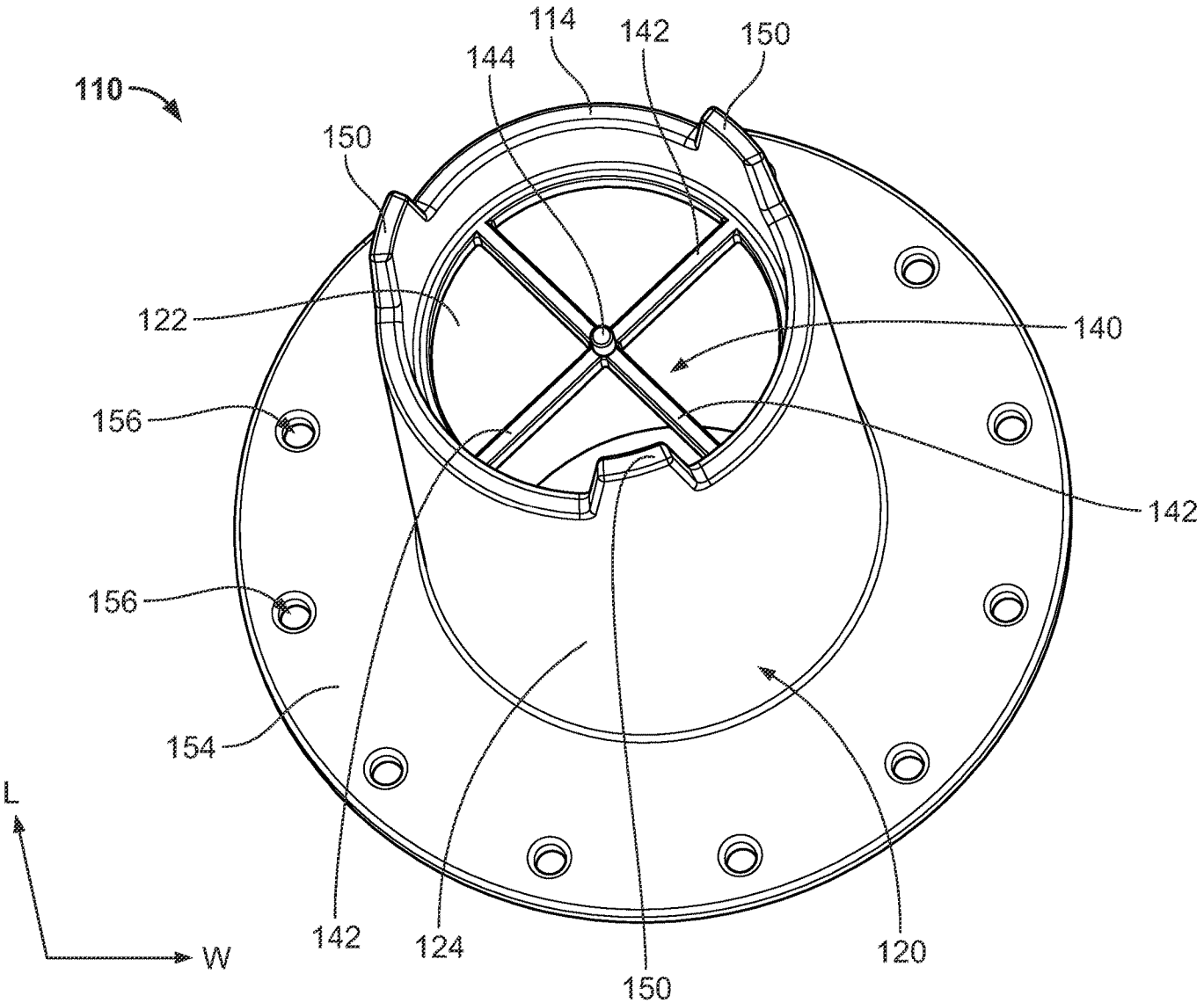
FIG. 3 is a perspective view of a vent body of the vent.

The vent body 110, as shown in FIGS. 2 and 3, extends from a first vent end 112 to a second vent end 114 along a longitudinal direction L of the vent body 110. The vent body 110 includes a vent pipe 120 extending from the first vent end 112 to the second vent end 114 opposite the first vent end 112, a body flange 154 positioned along the vent pipe 120 between the first vent end 112 and the second vent end 114, and a lip 158 disposed at the first vent end 112.

As shown in FIGS. 2 and 3, the vent pipe 120 has an inner surface 122 and an outer surface 124 opposite the inner surface 122 in a width direction W perpendicular to the longitudinal direction L. The vent pipe 120 has a vent passageway 126 extending through the vent pipe 120 from the first vent end 112 to the second vent end 114.

The vent pipe 120, as shown in FIG. 2, has a first section 130 extending from the first vent end 112 to the body flange 154 and a second section 134 extending from the body flange 154 to the second vent end 114. In the shown embodiment, the first section 130 has a first diameter 132 at the inner surface 122 of the vent pipe 120 that is larger than a second diameter 136 of the second section 134 at the inner surface 122 of the vent pipe 120. In another embodiment, the first diameter 132 is approximately the same as the second diameter 136, i.e. within 1%.

As shown in FIGS. 2 and 3, the vent pipe 120 has a support structure 140 spanning the vent passageway 126 of the vent pipe 120 adjacent to the second vent end 114. The support structure 140, in the shown embodiment, includes a plurality of braces 142 connected to the inner surface 122 and forming a cross-shape. The support structure 140 has a knob 144 disposed on the braces 142 and protruding in the longitudinal direction L. The knob 144 is disposed approximately centrally along the vent passageway 126.

At the second vent end 114 of the vent body 110, as shown in FIGS. 2 and 3, the vent pipe 120 has a plurality of protrusions 150 extending from the second vent end 114 in the longitudinal direction L. The protrusions 150 are separated from one another circumferentially about the second vent end 114 by a plurality of vent openings 152. The protrusions 150 are evenly spaced around then circumference of the second vent end 114. In the shown embodiment, three protrusions 150 extend from the second vent end 114 of the vent body 110. In other embodiments, less than three or more than three protrusions 150 may extend from the second vent end 114 and are spaced circumferentially with respect to one another, and the sizes of the vent openings 152 may vary based on the embodiment.

The body flange 154, as shown in FIGS. 2 and 3, extends in the width direction W from the outer surface 124 of the vent pipe 120 between the first vent end 112 and the second vent end 114. The body flange 154 extends around an entire circumference of the outer surface 124. The body flange 154 has a plurality of first fastener openings 156 distributed circumferentially around the body flange 154 and extending through the body flange 154 in the longitudinal direction L.

Figure 4:
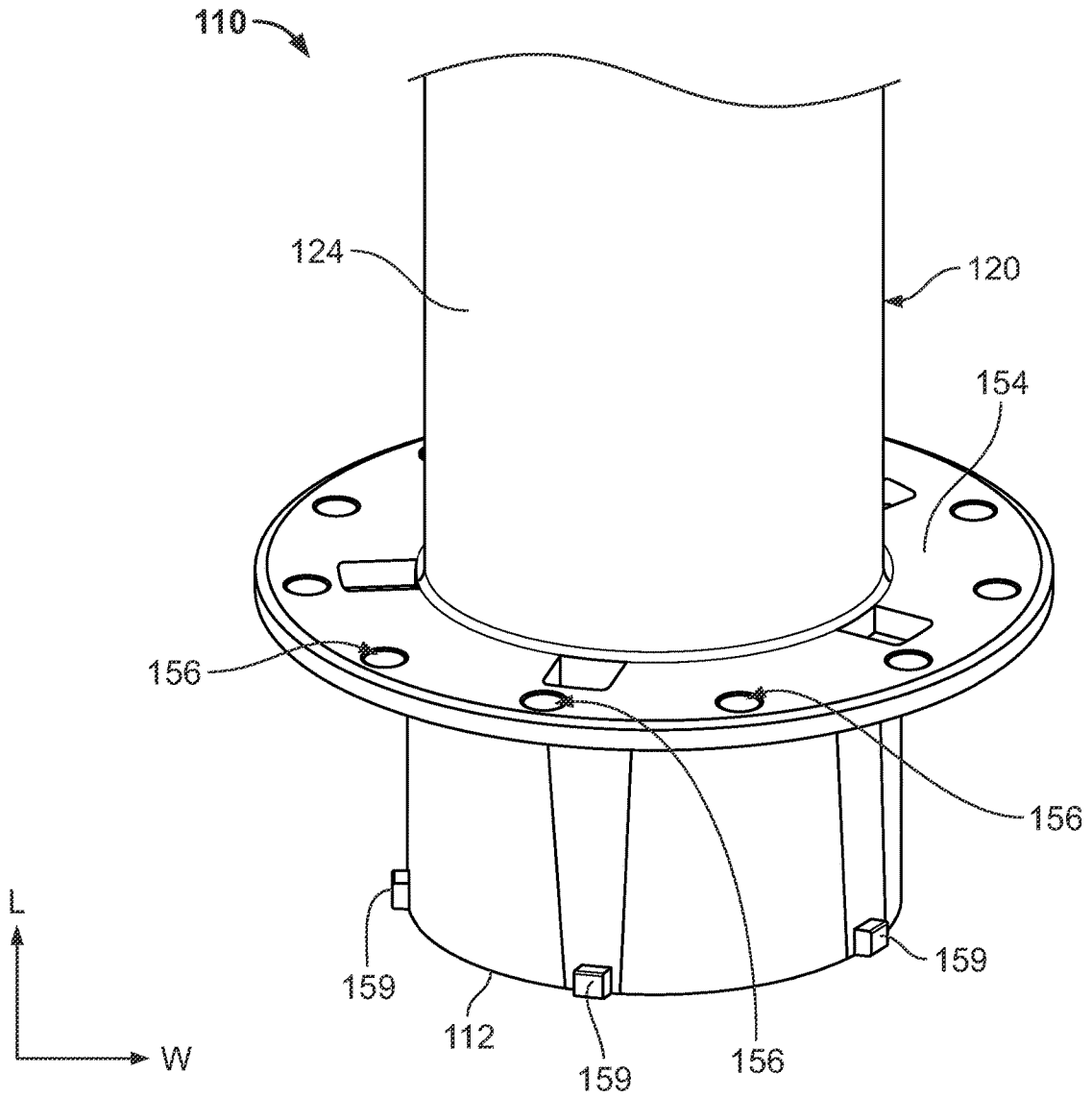
FIG. 4 is a perspective view of a vent body according to another embodiment.

In the embodiment shown in FIGS. 1 and 2, the vent pipe 120 has the lip 158 at the first vent end 112. The lip 158 extends from the outer surface 124 of the vent pipe 120 at the first vent end 112 in the width direction W around an entirety of the circumference of the first vent end 112. In another embodiment, shown in FIG. 4, the vent pipe 120 may have a plurality of nubs 159 extending from the outer surface 124 of the vent pipe 120 at the first vent end 112 instead of the lip 158. The plurality of nubs 159 extend from the first vent end 112 in the width direction W and are spaced evenly around the circumference of the first vent end 112. In another embodiment, the vent pipe 120 may have neither the lip 158 nor the nubs 159, and may just have a straight outer surface 124 at the first vent end 112.

The vent body 110, including the vent pipe 120, the body flange 154, and optionally the lip 158 or nubs 159, is monolithically formed in a single piece. The vent body 110 may be monolithically formed from a plastic material, such as polyvinyl chloride (PVC), and may be injection molded into the monolithic piece.

In the embodiment shown in FIG. 2, the vent 100 has a valve 160 disposed within the vent pipe 120. The valve 160 is formed of a flexible resilient material, such as a rubber material, and extends from a central opening 162 to an outer rim 164. The valve 160 is secured to the support structure 140 of the vent pipe 120. The valve 160 is positioned with the knob 144 extending through the central opening 162; the valve 160 is elastically retained on the knob 144. The valve 160 spans the vent passageway 126 and, as described in greater detail below, seals the vent passageway 126 in one direction. In another embodiment, the support structure 140 and the valve 160 can be omitted.

The boot 170, as shown in FIGS. 1 and 2, extends from a first boot end 172 to a second boot end 174 opposite the first boot end 172. The boot 170 has a boot flange 176 disposed at the first boot end 172 and an S-shaped section 178 positioned between the boot flange 176 and the second boot end 174. The boot 170 is monolithically formed from a flexible resilient material, such as a rubber material, for example ethylene propylene diene monomer (EPDM) rubber. The S-shaped section 178 changes shape during resilient deformation of the boot 170.

As shown in FIG. 2, the second boot end 174 is connected to the outer surface 124 of the vent pipe 120. In the initial position of the vent 100 shown in FIGS. 1 and 2, prior to installation of the vent 100 described in greater detail below, the boot flange 176 is disposed in a same plane as the body flange 154.

The cap 180, shown in FIGS. 1 and 2, has a base 182, a sidewall 184 extending from the base 182, and a rim 186 extending from the base 182 within the sidewall 184. The cap 180 is monolithically formed in a single piece, for example from a plastic material, such as polyvinyl chloride (PVC).

As shown in FIGS. 1 and 2, the cap 180 is positioned over the second vent end 114 of the vent pipe 120. The base 182 abuts the protrusions 150 and the sidewall 184 extends beyond the second vent end 114 in the longitudinal direction L. In an embodiment, the rim 186 is sized to receive the protrusions 150 with a form fit.

Figure 5:
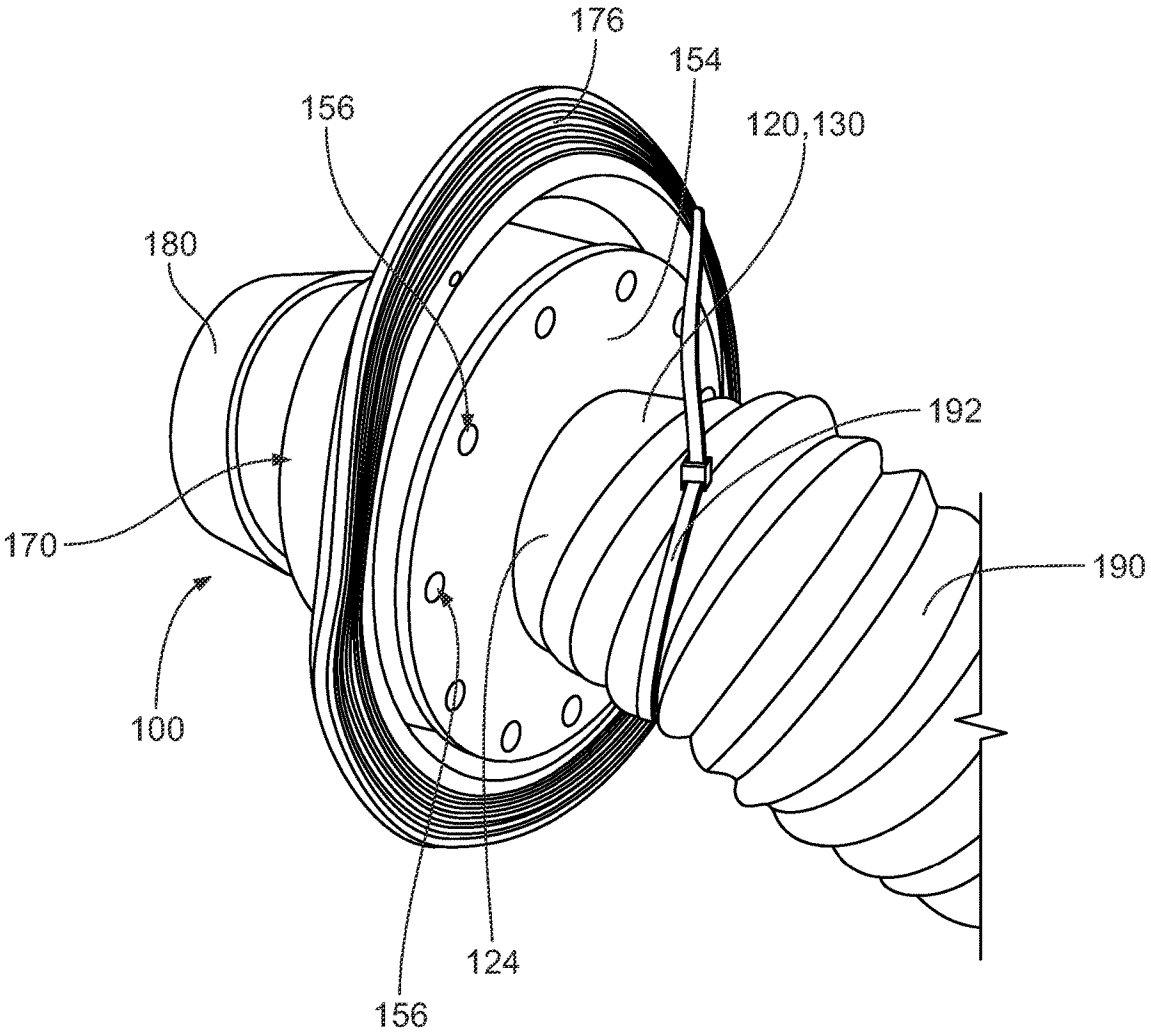
FIG. 5 is a perspective view of the vent attached to a hose.

In an exemplary application shown in FIG. 5, the vent 100 is attached to a hose 190. The hose 190 may be a ducting material or any other type of tubing capable of being attached in the manner described herein. An end of the hose 190 is positioned around the first section 130 of the vent pipe 120 and the hose 190 is attached to the first vent end 112 of the vent pipe 120. A securing element 192, such as a zip tie, is positioned around the hose 190 to attach the hose 190 around the first vent end 112. In embodiments in which the first vent end 112 has a lip 158 or nubs 159, the hose 190 is disposed around the lip 158 or nubs 159 and the lip 158 or nubs 159 help to secure the hose 190 around the outer surface 124 of the vent pipe 120.

Figure 6:
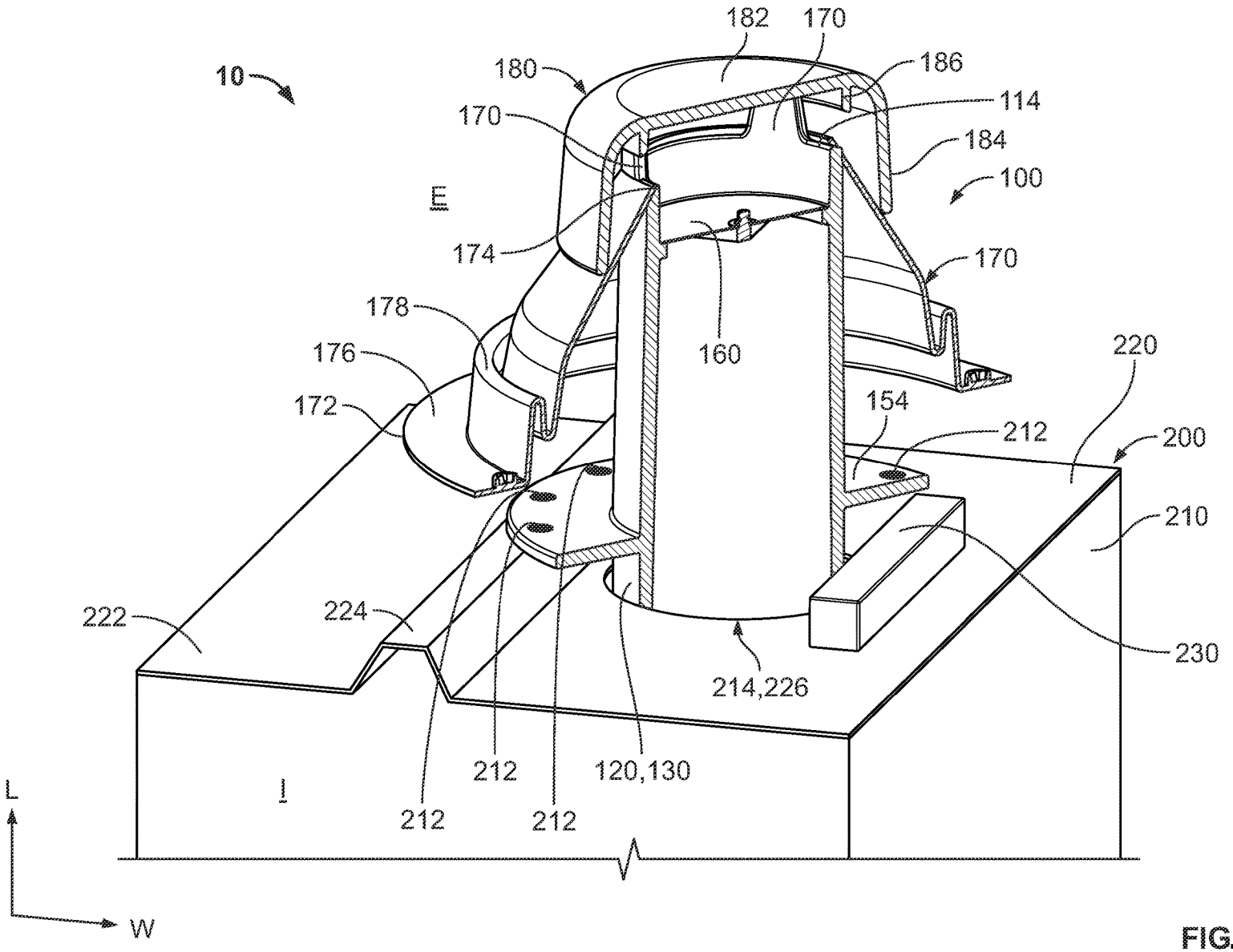
FIG. 6 is a partially sectional perspective view of a roof vent assembly according to an embodiment.
Figure 7:
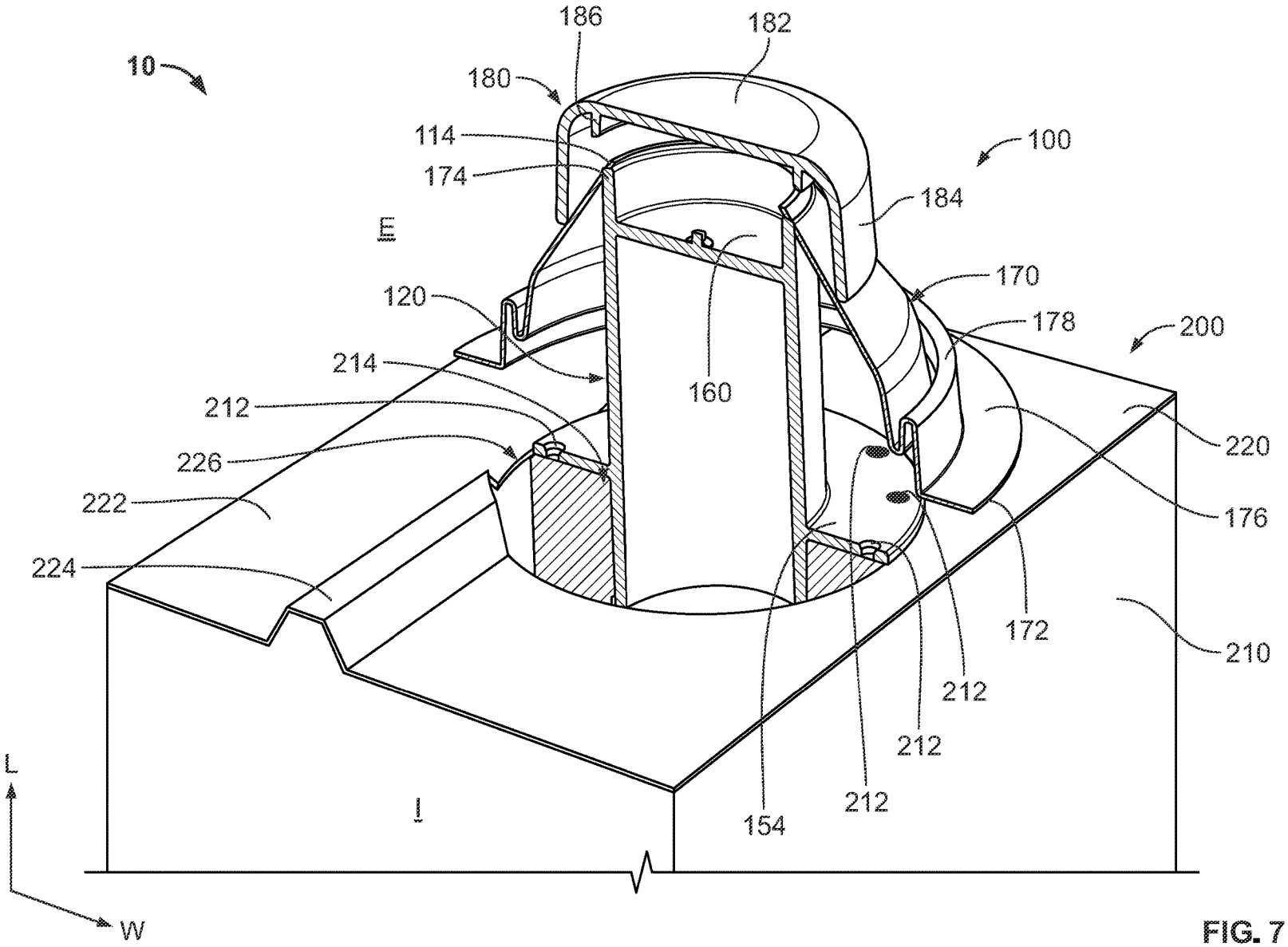
FIG. 7 is a partially sectional perspective view of a roof vent assembly according to another embodiment.
Figure 8:
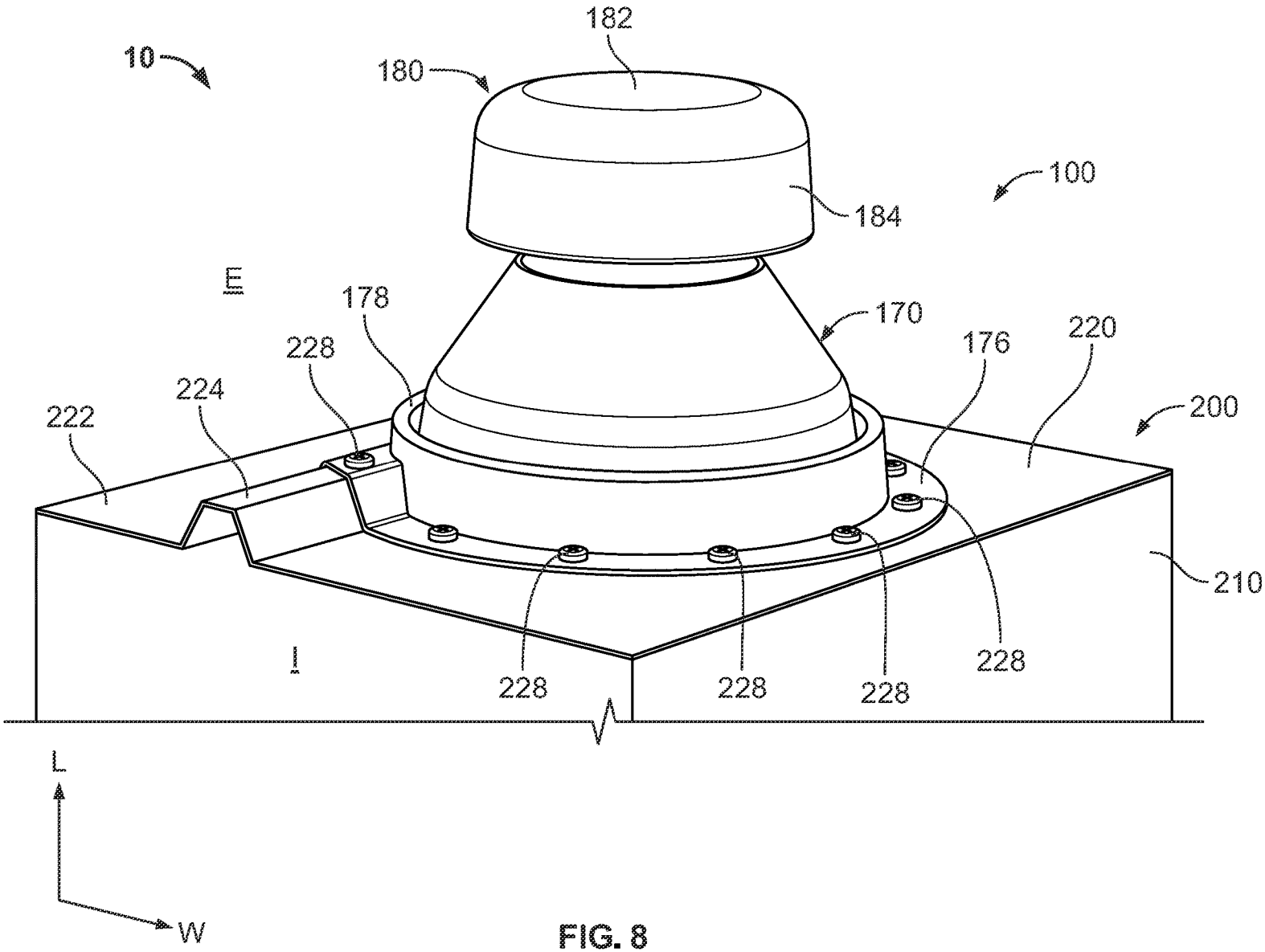
FIG. 8 is a perspective view of the vent fully installed on the roof to form the roof vent assembly.

A roof vent assembly 10 according to various embodiments is shown in FIGS. 6-8. The roof vent assembly 10 includes the vent 100 described in detail above and a roof 200 on which the vent 100 is attached.

The roof 200, as shown in FIGS. 6 and 7, includes a decking 210 and a covering layer 220 disposed on the decking 210. The decking 210 may be made of wood or any other material used as the underlying structure of a roof. The decking 210 covers an interior area I defined by the roof 200. The decking 210 has a passageway 214 extending through the decking 210 in the longitudinal direction L in which the vent 100 is disposed.

In the shown embodiment, the covering layer 220 is a layer of a metal material, such as copper, aluminum, or steel, that is exposed to the elements in an exterior area E of the roof 200. As shown in FIGS. 6-8, the covering layer 220 has a rib 224 protruding on an outer surface 222 of the covering layer 220. The covering layer 220 may be an exposed fastener or a concealed fastener metal roof. The covering layer 220 has an opening 226 extending through the covering layer 220 in the longitudinal direction L in which the vent 100 is disposed; the opening 226 communicates with the passageway 214.

The assembly of the vent 100 on the roof 200 to form the roof vent assembly 10 will now be described in greater detail with respect to FIGS. 6-8.

In the embodiment shown in FIG. 6, the passageway 214 and the opening 226 have a same outer dimension. The vent pipe 120 of the vent 100 is positioned through the opening 226 with the first section 130 of the vent pipe 120 extending through the passageway 214. In the embodiment shown in FIG. 6, the body flange 154 is positioned in direct abutment with the rib 224 on the outer surface 222 of the covering layer 220. In this embodiment, the roof 200 includes a spacer 230 disposed on the covering layer 220 and positioned under a side of the body flange 154 opposite the rib 224; the body flange 154 abuts the spacer 230. The roof 200 includes a plurality of first fasteners 212, such as screws, extending through the first fastener openings 156 and attaching the body flange 154 to the rib 224 and the spacer 230.

In another embodiment shown in FIG. 7, the opening 226 of the covering layer 220 is cut wider than the passageway 214 of the decking 210. In this embodiment, the body flange 154 is positioned in the opening 226 of the covering layer 220 and directly abuts the decking 210. The first fasteners 212 in this embodiment extend through the first fastener openings 156 of the body flange 154 and attach the body flange 154 to the decking 210.

In both embodiments, after the body flange 154 is attached directly to the rib 224 and the spacer 230 or directly to the decking 210, the boot flange 176 is resiliently moved into contact with the covering layer 220, as shown in FIG. 8. The boot flange 176 directly abuts the outer surface 222 of the covering layer 220 around an entire circumference of the boot flange 176; the boot 170 is resiliently deformed to extend over the rib 224. The S-shaped section 178 can, if necessary, change shape to accommodate the movement of the boot flange 176 into contact with the outer surface 222. As shown in FIG. 8, a plurality of second fasteners 228, such as screws, attach the boot flange 176 to the covering layer 220. When installed, as shown in FIGS. 6-8, at least a portion of the boot flange 154 is disposed in a same plane as the body flange 154.

The vent 100 fluidly connects the interior area I inside the roof 200 with the exterior area E exterior to the roof 200. In one application, the hose 190 is connected to the vent 100 to exhaust the interior area I of a bathroom to the exterior area E. In this embodiment, the valve 160 only permits movement of air in one direction; from the first vent end 112 and out through the second vent end 114. While the fluid is traveling in this direction, the valve 160 is deflected above the support structure 140 to open. When fluid is traveling in the opposite direction in through the second vent end 114, the valve 160 is pressed against the support structure 140 and does not permit the fluid to reach the first vent end 112; the vent passageway 126 is sealed in this direction. In another exemplary application, such as for attic ventilation, the hose 190 and the valve 160 are omitted and the vent 100 communicates air in both directions between the interior area I and the exterior area E.

In all embodiments, the boot 170 and the cap 180 prevent the ingress of moisture and dirt into the vent 100. The boot 170 forms a seal with the covering layer 220 at the boot flange 176 to prevent moisture and dirt from entering the passageway 214 of the decking 210 and the opening 226 of the covering layer 220, and the cap 180 covers the second vent end 114 to prevent moisture and dirt from entering the vent pipe 120.

What is claimed is:

1. A vent, comprising:

a vent body having a vent pipe and a body flange monolithically formed in a single piece with the vent pipe, the vent pipe has a vent passageway extending through the vent pipe from a first vent end to an opposite second vent end, the body flange is positioned along the vent pipe between the first vent end and the second vent end; and a boot formed of a flexible resilient material and having a first boot end with a boot flange and a second boot end connected to an outer surface of the vent pipe, at least a portion of the boot flange is disposed in a same plane as the body flange, the body flange provides a primary structural attachment, and the boot flange provides a secondary seal with a surrounding surface that is independent of attachment of the body flange.

2. The vent of claim 1, wherein the vent pipe has a lip or a plurality of nubs extending from the outer surface of the vent pipe at the first vent end and monolithically formed with the vent pipe and the body flange.

3. The vent of claim 2, further comprising a hose attached to the first vent end of the vent pipe.

4. The vent of claim 3, wherein the hose is disposed around the lip or nubs and attached to the vent pipe by a securing element extending around the hose.

5. The vent of claim 1, further comprising a valve disposed within the vent pipe, the valve sealing the vent passageway in one direction.

6. The vent of claim 5, wherein the vent pipe has a support structure spanning the vent passageway adjacent to the second vent end, the valve is secured to the support structure.

7. The vent of claim 6, wherein the support structure includes a plurality of braces and a knob disposed centrally along the vent passageway, the valve is elastically retained on the knob.

8. The vent of claim 1, wherein the vent pipe has a plurality of protrusions extending from the second vent end, the protrusions are separated from one another circumferentially by a plurality of vent openings.

9. The vent of claim 8, further comprising a cap disposed on the vent pipe, the cap has a base abutting the protrusions and a sidewall extending beyond the second vent end in a longitudinal direction of the vent pipe.

10. The vent of claim 1, wherein the vent pipe has a first section extending from the first vent end to the body flange and a second section extending from the body flange to the second vent end, the first section has a larger diameter than the second section.

11. The vent of claim 1, wherein the boot has an S-shaped section between the boot flange and the second boot end, the S-shaped section changes shape during resilient deformation of the boot.

12. The roof vent of claim 1, wherein the boot is connected to the vent pipe at a location axially offset from the body flange such that the boot does not intersect the body flange at the vent pipe.

13. A roof vent assembly, comprising:

a roof including a decking and a covering layer on the decking, the decking has a passageway extending through the decking and the covering layer has an opening communicating with the passageway; and a vent attached to the roof and fluidly connecting an area interior to the roof with an area exterior to the roof, the vent includes a vent body and a boot connected to the vent body, the vent body has a vent pipe and a body flange monolithically formed in a single piece with the vent pipe, the vent pipe has a vent passageway extending through the vent pipe from a first vent end to an opposite second vent end, the body flange is positioned along the vent pipe between the first vent end and the second vent end, the boot is formed of a flexible resilient material and has a first boot end with a boot flange and a second boot end connected to an outer surface of the vent pipe, the boot flange is attached to the covering layer and at least a portion of the boot flange is disposed in a same plane as the body flange, the vent body is fixed relative to the roof and the boot deforms to accommodate uneven roof contour.

14. The roof vent assembly of claim 13, wherein the covering layer has a rib protruding on an outer surface of the covering layer.

15. The roof vent assembly of claim 14, wherein the boot flange directly abuts the covering layer and extends over the rib.

16. The roof vent assembly of claim 15, wherein the boot flange is attached to the covering layer by a plurality of second fasteners.

17. The roof vent assembly of claim 15, wherein the body flange is disposed in the opening of the covering layer and directly abuts the decking.

18. The roof vent assembly of claim 17, further comprising a plurality of first fasteners extending through the body flange and attaching the body flange to the decking.

19. The roof vent assembly of claim 15, wherein the body flange abuts and is attached to the rib.

20. The roof vent assembly of claim 19, wherein the roof has a spacer disposed on the covering layer, the body flange abuts and is attached to the spacer.

21. The roof vent assembly of claim 14, wherein the covering layer is formed of a metal material.

22. The roof vent assembly of claim 13, wherein the body flange is attached directly to the decking, and the boot flange seals the opening in the covering layer independently of the attachment of the body flange.

* * * * *